US006061973A

United States Patent [19]

Accardi et al.

[11] Patent Number: 6,061,973

[45] Date of Patent: May 16, 2000

[54] ROOF VENTING SYSTEM FOR TRUSSED AND RAFTERED ROOFS

[76] Inventors: George J. Accardi, 1871-11th Ct., Friendship, Wis. 53934; Rory W. Hansen, 121 Oneida Ct., Bloomingdale, Ill. 60108

[21] Appl. No.: 09/090,141

[22] Filed: Jun. 4, 1998

[51] Int. Cl.[7] ..... E04B 9/02

[52] U.S. Cl. ..... 52/90.1; 52/98; 52/199; 52/630

[58] Field of Search ..... 52/90.1, 98, 199, 52/630, 712

[56] References Cited

U.S. PATENT DOCUMENTS

| | | | |
|---|---|---|---|
| 2,476,499 | 7/1949 | Lowell | 52/630 |
| 5,299,405 | 4/1994 | Thompson | 52/630 X |
| 5,341,612 | 8/1994 | Robbins | 52/95 |
| 5,600,928 | 2/1997 | Hess et al. | 52/630 X |

FOREIGN PATENT DOCUMENTS

| | | | |
|---|---|---|---|
| NR. 57816 | 7/1940 | Denmark | 52/630 |

*Primary Examiner*—Carl D. Friedman
*Assistant Examiner*—Brian E. Glessner

[57] ABSTRACT

A new roof venting system for trussed and raftered roofs for improving ventilation in a structure. The inventive device includes a generally planar rectangular sheet positionable on rafters of a roof frame. The sheet has a plurality of upwardly extending recesses formed therein in an equally spaced relationship corresponding with spacing of the rafters. A plurality of stabilizer bars are secured to the sheet between the recesses thereof.

1 Claim, 1 Drawing Sheet

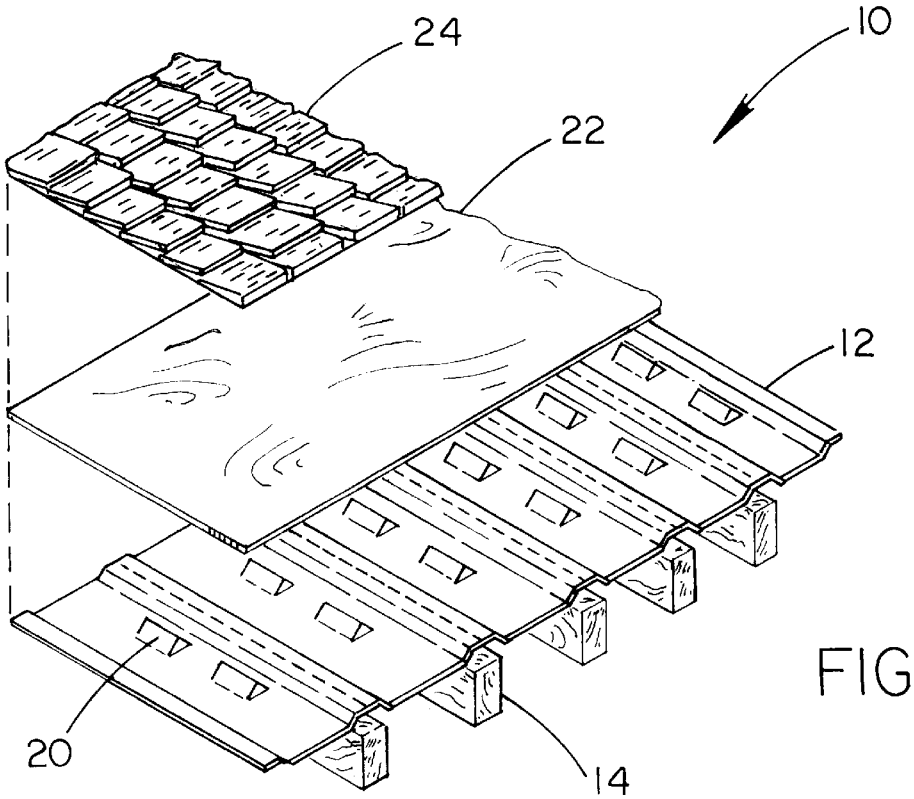
FIG. 1
FIG. 2
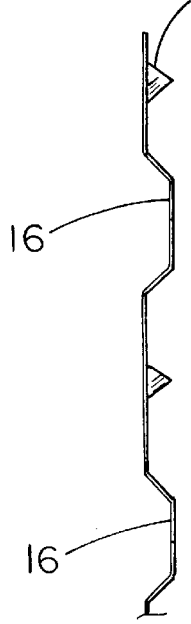
FIG. 2A
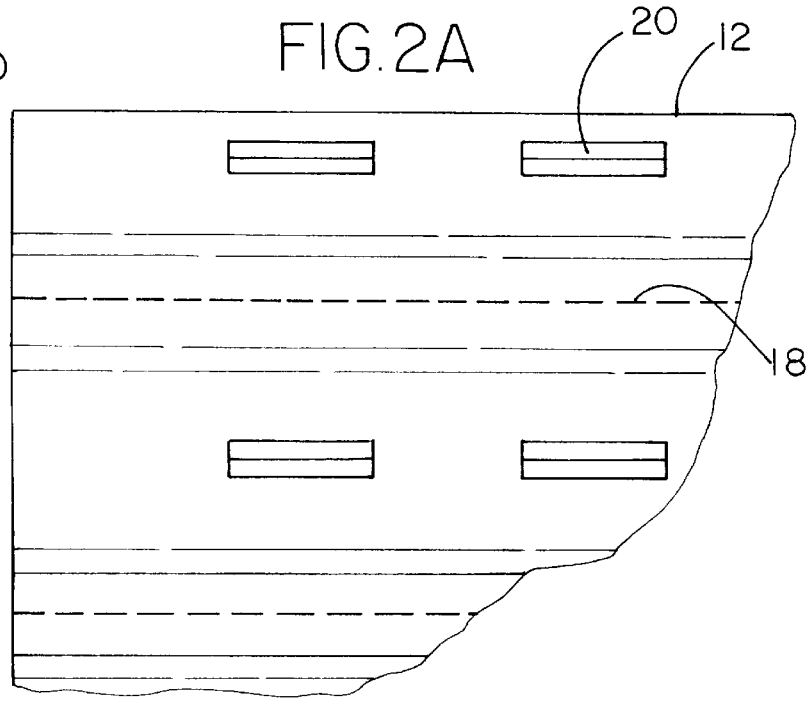

ROOF VENTING SYSTEM FOR TRUSSED AND RAFTERED ROOFS

BACKGROUND OF THE INVENTION

1. Field of the Invention

The present invention relates to roof ventilation devices and more particularly pertains to a new roof venting system for trussed and raftered roofs for improving ventilation in a structure.

2. Description of the Prior Art

The use of roof ventilation devices is known in the prior art. More specifically, roof ventilation devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art roof ventilation devices include U.S. Pat. No. 4,977,714 to Gregory, Jr.; U.S. Pat. No. 5,094,054 to Arends; U.S. Pat. No. 3,938,429 to Perry; U.S. Pat. No. 4,674,249 to Bennett, Jr.; U.S. Pat. No. 4,581,861 to Eury; and U.S. Pat. No. Des. 277,230 to Williamson et al.

While these devices fulfill their respective, particular objectives and requirements, the aforementioned patents do not disclose a new roof venting system for trussed and raftered roofs. The inventive device includes a generally planar rectangular sheet positionable on rafters of a roof frame. The sheet has a plurality of upwardly extending recesses formed therein in an equally spaced relationship corresponding with spacing of the rafters. A plurality of stabilizer bars are secured to the sheet between the recesses thereof.

In these respects, the roof venting system for trussed and raftered roofs according to the present invention substantially departs from the conventional concepts and designs of the prior art, and in so doing provides an apparatus primarily developed for the purpose of improving ventilation in a structure.

SUMMARY OF THE INVENTION

In view of the foregoing disadvantages inherent in the known types of roof ventilation devices now present in the prior art, the present invention provides a new roof venting system for trussed and raftered roofs construction wherein the same can be utilized for improving ventilation in a structure.

The general purpose of the present invention, which will be described subsequently in greater detail, is to provide a new roof venting system for trussed and raftered roofs apparatus and method which has many of the advantages of the roof ventilation devices mentioned heretofore and many novel features that result in a new roof venting system for trussed and raftered roofs which is not anticipated, rendered obvious, suggested, or even implied by any of the prior art roof ventilation devices, either alone or in any combination thereof.

To attain this, the present invention generally comprises a generally planar rectangular sheet positionable on rafters of a roof frame. The sheet has a plurality of upwardly extending recesses formed therein in an equally spaced relationship corresponding with spacing of the rafters. The recesses each have a perforated line disposed within a central section extending a length thereof for dividing the sheet into smaller segments. A plurality of stabilizer bars are secured to the sheet between the recesses thereof. The bars are positioned in groups of two between each recess. The bars have a triangular cross-section with an apex thereof at height essentially equal to a height of the recesses.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new roof venting system for trussed and raftered roofs apparatus and method which has many of the advantages of the roof ventilation devices mentioned heretofore and many novel features that result in a new roof venting system for trussed and raftered roofs which is not anticipated, rendered obvious, suggested, or even implied by any of the prior art roof ventilation devices, either alone or in any combination thereof.

It is another object of the present invention to provide a new roof venting system for trussed and raftered roofs which may be easily and efficiently manufactured and marketed.

It is a further object of the present invention to provide a new roof venting system for trussed and raftered roofs which is of a durable and reliable construction.

An even further object of the present invention is to provide a new roof venting system for trussed and raftered roofs which is susceptible of a low cost of manufacture with regard to both materials and labor, and which accordingly is then susceptible of low prices of sale to the consuming public, thereby making such roof venting system for trussed and raftered roofs economically available to the buying public.

Still yet another object of the present invention is to provide a new roof venting system for trussed and raftered roofs which provides in the apparatuses and methods of the prior art some of the advantages thereof, while simultaneously overcoming some of the disadvantages normally associated therewith.

Still another object of the present invention is to provide a new roof venting system for trussed and raftered roofs for improving ventilation in a structure.

Yet another object of the present invention is to provide a new roof venting system for trussed and raftered roofs which includes a generally planar rectangular sheet positionable on rafters of a roof frame. The sheet has a plurality of upwardly extending recesses formed therein in an equally spaced relationship corresponding with spacing of the rafters. A plurality of stabilizer bars are secured to the sheet between the recesses thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of a new roof venting system for trussed and raftered roofs according to the present invention illustrated in use.

FIG. 2 is a side view of the present invention.

FIG. 2A is a top plan view of the present invention.

DESCRIPTION OF THE PREFERRED EMBODIMENT

With reference now to the drawings, and in particular to FIGS. 1 through 2A thereof, a new roof venting system for trussed and raftered roofs embodying the principles and concepts of the present invention and generally designated by the reference numeral 10 will be described.

As best illustrated in FIGS. 1 through 2A, the roof venting system for trussed and raftered roofs 10 comprises a generally planar rectangular sheet 12 positionable on rafters 14 of a roof frame. The sheet 12 has a plurality of upwardly extending recesses 16 formed therein in an equally spaced relationship corresponding with spacing of the rafters 14. The recesses 16 each have a perforated line 18 disposed within a central section extending a length thereof for dividing the sheet 12 into smaller segments.

A plurality of stabilizer bars 20 are secured to the sheet between the recesses thereof. The bars 20 are positioned in groups of two between each recess 16. The bars 20 have a triangular cross-section with an apex thereof at height essentially equal to a height of the recesses 16.

In use, the sheets 12 are placed on the roof structure with the recesses 16 receiving the upper edges of the rafters 14 therein, as illustrated in FIG. 1. Next, a sheet of plywood 22 is secured over the sheet 12. Shingles 24 or tile are then secured to the plywood 22 for the outer appearance of the roof. The roof can then be insulated from inside the house. Once the insulation is injected between the rafters 14, the stabilizer bars 20 will prevent the sheet 12 from collapsing upwardly against the plywood 22. Additionally, the stabilizer bars 20 will also create a pair of channels to allow for the continued air flow and ventilation between the insulation and sheet of plywood 22.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are denied readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A roof venting system for improving ventilation in a structure comprising, in combination:

a roof frame having a plurality of substantially equally spaced and substantially parallel rafters for supporting a roof deck, each of the rafters having an upper edge surface;

a roof deck having a lower surface resting on the upper edge surfaces of the plurality of substantially parallel rafters; and a generally planar rectangular sheet being disposed between the rafters and the roof deck of the roof frame, tile sheet having a top surface and a bottom surface, the sheet having a plurality of upwardly extending recesses formed in the bottom surface thereof in an equally spaced relationship corresponding to the substantially equal spacing of the rafters, each of the recesses in the bottom surface of the sheet resting on the upper edge surface of a rafter with the lower surface of the roof deck resting on the top surface of the sheet such that the sheet extends continuously over the upper edge surface of each of the rafters, the recesses each having a perforated line disposed within a central section extending a length thereof for permitting dividing of the sheet into smaller segments; wherein a plurality of stabilizer bars are formed in the sheet between the recesses thereof, stabilizer bars being positioned a distance from a front edge of the sheet, the distance being between one and one-half times and two times a length the bars being positioned in groups of two between each recess, the bars having a triangular cross-section with an apex thereof at height essentially equal to a height of the recesses.

* * * * *